US005570869A

United States Patent [19]

Diaz et al.

[11] Patent Number: 5,570,869

[45] Date of Patent: Nov. 5, 1996

[54] SELF-CALIBRATING WATER FLUID CONTROL APPARATUS

[75] Inventors: Alexander R. Diaz, Greer, S.C.; Ronald L. Roush, Colorado Springs, Colo.

[73] Assignee: T & S Brass and Bronze, Inc., Travelers Rest, S.C.

[21] Appl. No.: 359,439

[22] Filed: Dec. 20, 1994

[51] Int. Cl.[6] ..... E03D 5/10

[52] U.S. Cl. ..... 251/129.04; 4/304; 4/623

[58] Field of Search ..... 251/129.04; 4/623, 4/304, DIG. 3; 250/221, 221.1, 205

[56] References Cited

U.S. PATENT DOCUMENTS

| | | | |
|---|---|---|---|
| 4,309,781 | 1/1982 | Lissau | 4/623 |
| 4,682,628 | 7/1987 | Hill | 251/129.04 |
| 4,735,357 | 4/1988 | Gregory et al. . | |
| 4,921,211 | 5/1990 | Novak et al. . | |
| 4,941,219 | 7/1990 | Van Marcke . | |
| 4,972,070 | 11/1990 | Laverty, Jr. . | |
| 5,033,508 | 7/1991 | Laverty, Jr. . | |
| 5,133,095 | 7/1992 | Shiba et al. . | |
| 5,482,250 | 1/1996 | Kodaira | 251/129.04 |

OTHER PUBLICATIONS

AquaStat, Philipp Research & Development Labs, Inc., Lutz, Floriday, "Introducing a Revolutionary New Way to Automatically Turn Faucets On and Off . . . " (no date).

Illinois Master Plumber, Industry News, "Chicago Faucets Launches Eagle Eye Electronic Faucets," Mar. 1994, p. 47.

The Chicago Faucet Co., DePlaines, Illinois, Brochure regarding Eagle Eye Electronic Faucet (no date).

Coyne & Delany, Co., Charlotteville, Virginia, Brochure regarding The Delany Sensor–Faucets (from Mar. 7, 1994 meeting of ASPE).

Intersan, Brochure, pp. 1–5, regarding The Intersan Electronically Controlled Passive Detection System (dated Jun. 14, 1993).

*Primary Examiner*—Edward K. Look
*Assistant Examiner*—Christopher Verdier
*Attorney, Agent, or Firm*—Dority & Manning, P.A.

[57] ABSTRACT

A self-calibrating fluid flow control apparatus for use with a fluid flow source is provided. A detection area is defined wherein the interposition of an object therein causes a control device to activate the fluid flow source. A calibrating device is configured to continuously define, at a predetermined rate, a steady state boundary of the detection area, wherein the steady state boundary conforms to objects interposed within said detection area so that a new detection area is defined which is free of interposed objects capable of activating the fluid flow source. An object left indefinitely within the detection area will not, therefore, cause the control device to indefinitely activate the fluid flow source nor, after deactivation by a timing mechanism, prevent the fluid flow source's subsequent reactivation.

35 Claims, 4 Drawing Sheets

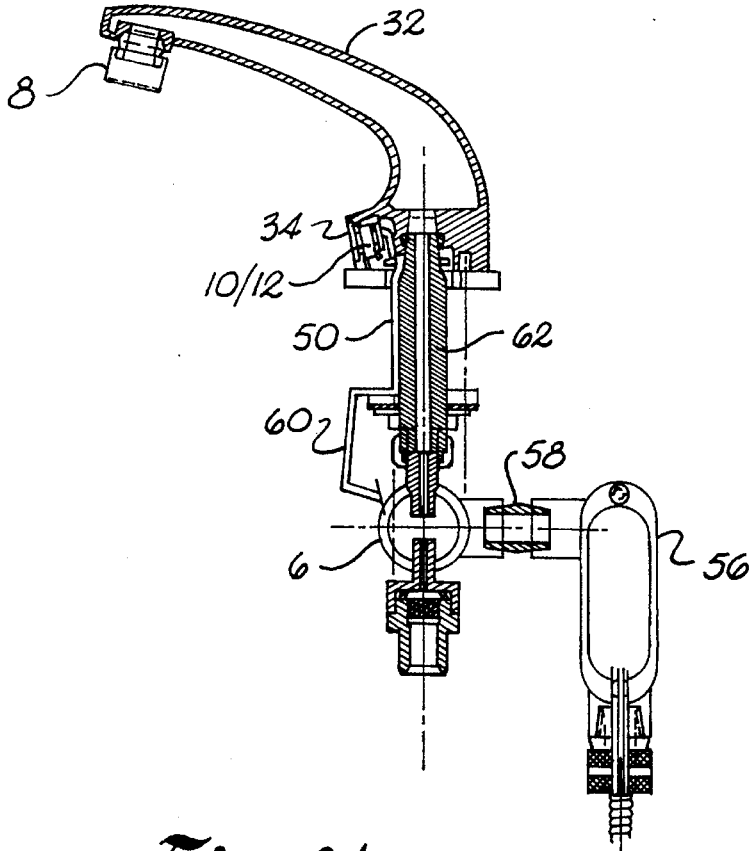
Fig. 3A
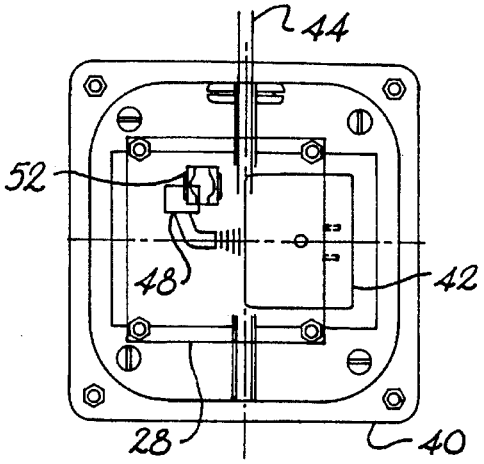
Fig. 3B
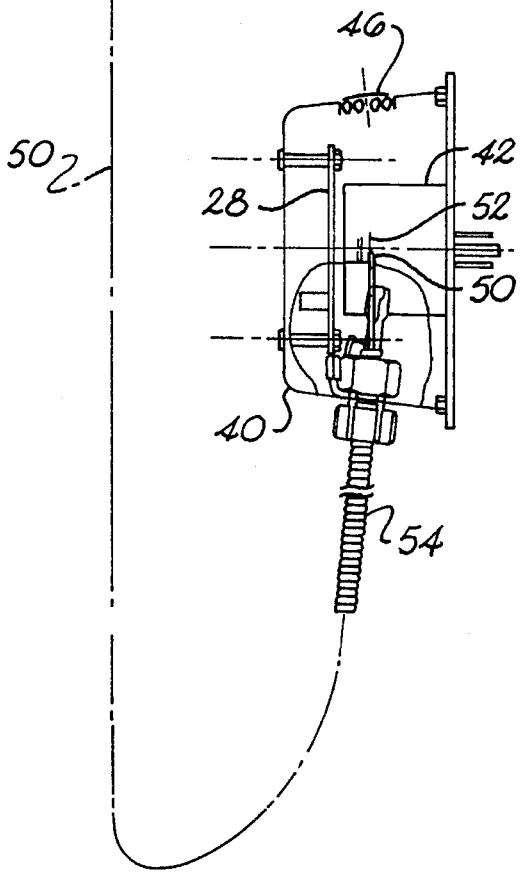

SELF-CALIBRATING WATER FLUID CONTROL APPARATUS

BACKGROUND OF THE INVENTION

The present invention relates to fluid flow control devices and more particularly to a continuously self-calibrating water flow control apparatus for utilization with a water flow system.

Automatic fluid control devices are presently in common use, particularly in association with water faucets or toilets. More specifically, it is known in the art to utilize motion detectors and object detectors, such as infrared, electrostatic or radar sensors, to detect the presence of an object within a detection area necessitating the activation of a water flow device.

Not all objects interposed within the detection area, however, should activate the water flow assembly. For example, while a hand placed in a sink should continuously activate a faucet, a towel accidentally dropped into the sink should not. Possible water wastage resulting from objects left indefinitely, unintentionally or through vandalism, in these detection areas poses a significant obstacle to the successful implementation of such automatic water flow control devices, particularly in public areas.

In general, one known solution to this problem includes timing devices to shut off water flow after a preset time following the faucet's activation. This, however, requires some method or device for reactivating water flow under the proper circumstances. One method is simply to deactivate water flow for a predetermined time period, thereafter permitting water flow upon the detection of an object or motion within the detection area. Another known method is to deactivate the water flow until the conditions that initially caused the water flow are removed. Thus, for example, if a towel were left in a sink, water flow would continue until the timing circuit deactivated the flow, which would remain deactivated until the towel was removed.

Both of the above-mentioned solutions result in further difficulties. If the fluid control device merely deactivates for a predetermined period, an object left in a sink indefinitely would cause the automatic faucet to repeatedly turn on and off, thereby still resulting in water wastage. On the other hand, if the fluid flow control device deactivates until the object in the sink is removed, the faucet is totally and unnecessarily inoperative. For example, a towel placed over the sink edge may initially activate the faucet. When the faucet deactivates after the preset time period, it will remain deactivated until the obstacle is removed. Someone subsequently attempting to operate the faucet would find that it would not work but might not realize that the towel must be removed to permit its use.

Still another difficulty encountered with automatic fluid flow control devices, such as are found in water faucet assemblies, involves calibration upon installation and changed ambient environments. When installed, such devices must be manually calibrated. That is, the device must be adjusted to define a detection area adjacent to the faucet such that when an object is interposed within this detection area, the faucet is activated. Such manual calibration is time consuming and results in inconsistent detection areas. For example, one faucet may be activated when a hand is placed three inches from the faucet, while an adjacent faucet might be activated at four inches.

Furthermore, a change in the ambient environment may require recalibration to ensure proper operation of the faucet.

For example, infrared sensor devices are heat sensitive. Accordingly, they may activate a faucet prematurely when room temperature is abnormally high or fail to activate the faucet when room temperature is abnormally low. Specifically, infrared devices have been known to fail to activate a faucet when a user's hands were too cold.

Infrared sensors are also color sensitive. Therefore, if a new sink is installed having a brighter color, the automatic water flow control device may require recalibration to prevent inappropriate faucet activation.

Thus, it is desirable to have a fluid flow control device that prevents fluid wastage due to objects left indefinitely within the detection area yet permits fluid flow thereafter under appropriate conditions. It is furthermore desirable to have such a device that self-calibrates upon installation and changes in environmental conditions.

SUMMARY OF THE INVENTION

It is a principle object of the present invention to provide a fluid flow control apparatus configured to continuously define a steady state boundary of a detection area, wherein the interposition of an object within said detection area causes a fluid flow control device to activate the faucet.

It is a further object of the present invention to provide a fluid flow control apparatus that continuously redefines the boundary of the detection area to conform to objects left for prolonged periods of time therein, thereby permitting the use of the faucet despite the presence of these objects within the detection area.

It is yet another object of the present invention to provide a fluid flow control apparatus which self-calibrates to compensate for a changed ambient environment.

Additional objects and advantages of the invention will be set forth in part in the description which follows, or may be learned by practice of the invention. The objects and advantages of the invention may be realized and obtained by means of the instrumentalities and combinations particularly pointed out in the appended claims.

To achieve the objects and in accordance with the purposes of the invention, as embodied and broadly described herein, a self-calibrating fluid control apparatus for utilization with fluid control system is provided. Generally, the fluid flow control apparatus comprises a control device and calibrating device that control the activation of, for example, a water flow assembly upon the interposition of an object within a defined detection area.

In one presently preferred embodiment, the control device comprises an infrared signal source configured to emit infrared signals into the detection area, an infrared receiver configured to receive infrared signal reflections from objects interposed within the detection area and to convert such reflections into corresponding electrical signals, and a control mechanism for controlling the activation of the water flow assembly responsive to the electrical signals. Specifically, the control mechanism compares the electrical signals with predetermined criteria corresponding to a position within the detection area at which the water flow assembly is to be activated. When an interposed object reaches this position, the control mechanism outputs a fluid flow source control signal to activate the water flow assembly.

The calibrating device generally comprises a calibrating mechanism that controls the output of the infrared signal source so to continuously redefine the detection area to accommodate objects left indefinitely therein. Specifically, the mechanism compares the electrical signals to predetermined criteria representing the expected value of electrical signals corresponding to infrared signals reflected from the existing detection area boundary. If an electrical signal exceeds such expected value, an object has been interposed within the detection area so as to reflect a stronger signal. In such a condition, the calibrating mechanism decrements, at a predetermined rate, the intensity of subsequently emitted infrared signals so that subsequent electrical signals again approximate the predetermined criteria.

Conversely, if the electrical signals fall below the predetermined criteria from a steady state, the detection area boundary has been removed or altered so as to reflect weaker signals. Such a condition might arise, for example, from placing a dark towel over a lighter color sink edge that comprises the outer boundary. In this case, the calibrating mechanism increments, at a predetermined rate, the intensity of subsequently emitted infrared signals so that subsequent electrical signals again approximate the predetermined criteria.

The predetermined criteria of this embodiment comprise two signals: a reference signal and a derived reference signal. The reference signal is utilized by the calibrating device as described above and corresponds to the expected intensity of infrared signals reflected from the detection area's outer boundary. The derived reference signal is set at a desired value at or above the reference signal and is utilized by the control mechanism to determine when the water flow assembly should be activated. The higher the derived reference signal is set above the reference signal, the closer an interposed object must be to the infrared signal source and receiver from the detection area's outer boundary to activate the water flow assembly.

In another embodiment, the calibrating device adjusts the predetermined criteria rather than the intensity of the emitted infrared signals. That is, the infrared signal source emits infrared signals having a constant intensity. If the electrical signals deviate from the reference and derived reference signals, the calibrating mechanism decrements or increments such signals to again approximate the electrical signals.

Regarding either of the above-described embodiments, the calibrating mechanism is configured to continuously redefine the detection area. More specifically, by approximating electrical signals to the reference signal, such mechanism redefines the detection area so that the objects interposed within a steady state detection area become the outer boundary of a subsequent detection area free of interposed objects.

A water flow assembly will, therefore, deactivate after a time determined by the rate at which the calibrating mechanism alters the infrared signal intensity or the reference and derived reference signals. However, in another preferred embodiment, the control device further comprises a timing mechanism configured to deactivate the water flow assembly after a predetermined activation period and to prevent reactivation until the interposed object is removed. Thus, both the timing mechanism and the calibrating mechanism tend to deactivate the water flow assembly after activation.

In this embodiment, the timing mechanism's deactivation period is shorter than the time required for the calibrating mechanism to redefine the detection area. Thus, an object left indefinitely within the detection area will cause the water flow assembly's activation for the predetermined activation period only. Furthermore, the timing mechanism will prevent subsequent reactivation as long as the object remains interposed within the detection area. The calibrating mechanism, however, shortly redefines the detection area to exclude the object. Thus, upon such redefinition, the water flow assembly may again be activated. Therefore, an object left indefinitely within the detection area will cause neither indefinite fluid flow or indefinite deactivation.

The method according to the present invention generally comprises the steps of selectively permitting the activation of a water flow assembly upon the interposition of an object within the detection area and continuously redefining the detection area to exclude such interposed objects.

More specifically, regarding one presently preferred embodiment, infrared signals are emitted into the detection area at a predetermined rate. Corresponding infrared signal reflections are subsequently received and converted to electrical signals. Such electrical signals are compared to predetermined criteria comprising signals corresponding to the detection area's outer boundary and to the point within the detection area at which an object therein causes the activation of the water flow assembly. If the electrical signals exceed the latter signal, fluid flow source control signals are output to activate the water flow assembly. If the electrical signals deviate from the former signal, the infrared signal source is recalibrated such that subsequent electrical signals more closely approximate such signal.

The accompanying drawings, which are incorporated in and constitute a part of this specification, illustrate one embodiment of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which:

FIG. 3A is a cross sectional view of the embodiment of the present invention as depicted in FIG. 2A;

FIG. 3B is a bottom view of the electrical control box as in FIG. 3A;

Figure 1:
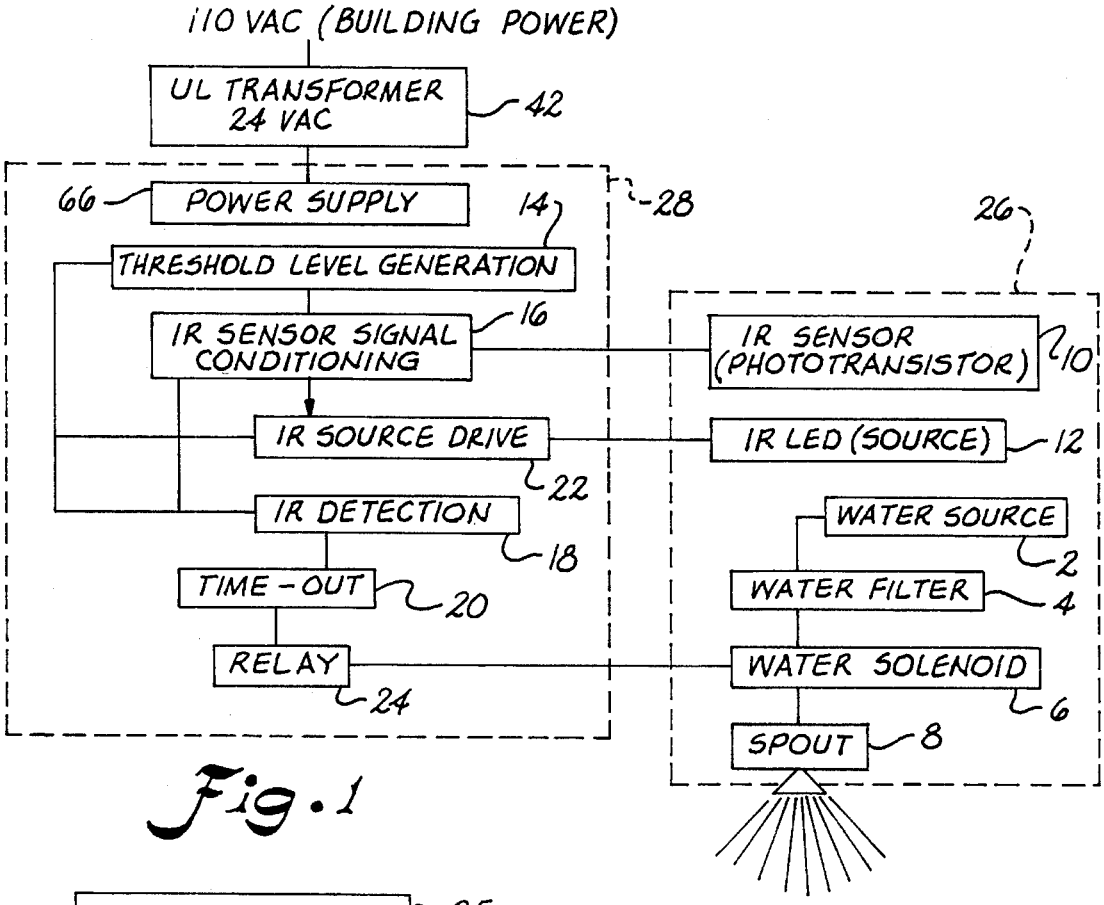
FIG. 1 is a block diagram illustration of an embodiment of the apparatus of the present invention.

Repeat use of reference characters in the following specification and appended drawings is intended to represent the same or analogous features, elements, or steps of the present invention.

DETAILED DESCRIPTION OF THE PREFERRED EMBODIMENTS

Reference will now be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

For example, one preferred embodiment is described below comprising analog circuitry. It is to be understood, however, that any and all equivalent realization of the present invention, such as comprising digital circuitry, are included within the scope and spirit thereof. Similarly, the self-calibrating fluid control apparatus may be utilized in conjunction with any manner of fluid flow assembly. For ease of explanation and illustration, the invention will be described with reference to water faucets and toilets. Furthermore, as will be recognized by those of ordinary skill in the art, many physical embodiments may be configured for practicing the method of the present invention. Thus, the embodiments depicted in the appended claims are presented by way of example only and are not intended as limitations upon the present invention.

The present invention is concerned with a continuously self-calibrating fluid flow control apparatus for utilization with a fluid flow system. Accordingly, FIG. 1 depicts, in block diagram form, one presently preferred embodiment of a continuously self-calibrating water flow control apparatus in operative utilization with a water flow assembly. The water flow system is comprised of water source 2, water filter 4, water solenoid valve 6, and spout 8. A control device is comprised of infrared receiver 10, infrared signal source 12, and a control mechanism comprising threshold level generator 14, infrared detection device 18, and timing mechanism 20. A calibrating device comprises a calibrating mechanism comprising infrared source drive 22. Additionally, an interface device 24 is operatively disposed between timing mechanism 20 and water solenoid 6.

Infrared receiver 10, infrared signal source 12 and the water flow system are housed in the faucet construction indicated by dashed line 26, which is discussed in more detail as part of a water faucet assembly below. Threshold level generator 14, infrared sensor signal conditioner 16, infrared source drive 22, infrared detection device 18, timing mechanism 20, and relay 24 comprise analog circuitry disposed on the electronic control board indicated by dashed line 28. It will be understood by those of ordinary skill in the art, however, from the discussion that follows that this configuration comprises but one presently preferred embodiment according to the present invention and that various equivalent modifications could be utilized.

Figure 5:
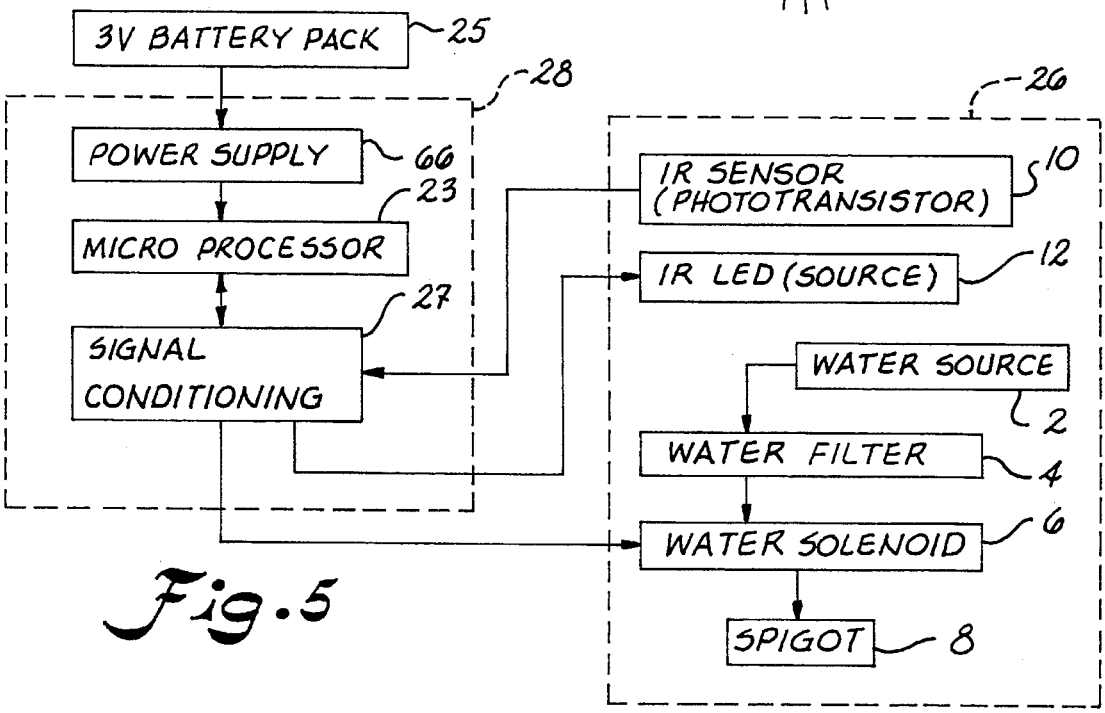
FIG. 5 is a block diagram illustration of an embodiment of the apparatus of the present invention including a microprocessor.

For instance, threshold level generator 14, infrared sensor signal conditioner 16, infrared source drive 22, infrared detection device 18, and timing mechanism 20 may alternatively be embodied by digital circuitry, specifically a microprocessor 23 as shown in FIG. 5. Such a configuration could utilize additional modifications from the presently preferred embodiment discussed below; for example, battery power means 25 could be employed. Additionally, microprocessor-specific signal conditioning circuitry 27, for example including buffers and amplifiers, may be required by such a realization. It is understood, however, that any and all such equivalent variations are within the spirit and scope of the present invention.

Referring again to FIG. 1, water flow from water source 2 through water filter 4 to spout 8 is controlled by water solenoid valve 6, as is well known in the art. Water solenoid valve 6 is, in turn, controlled by signals from relay 24 corresponding to fluid (here water) flow source control signals dependent upon infrared signal reflections received by infrared receiver 10.

In this embodiment, infrared signal source 12 emits, at a predetermined rate, infrared signals, or pulses, into a detection area adjacent to spout 8. The detection area may be defined as that area (or volume) within which interposed objects reflect such signals to infrared receiver 10 so as to activate water flow through water filter 4, water solenoid valve 6 and spout 8. That is, an object interposed within this detection area reflects infrared light emitted by infrared signal source 12 to infrared receiver 10. Infrared receiver 10, in turn, generates electrical signals corresponding to the received reflections and outputs these signals to infrared sensor signal conditioner 16. Infrared sensor signal conditioner 16 amplifies and detects these relatively weak signals and outputs amplified electrical signals to infrared source drive 22 and infrared detection device 18.

Infrared detection device 18 compares the amplified electrical signals to a signal derived from a reference signal provided from threshold level generator 14. The reference signal corresponds to the expected intensity of an infrared signal reflected from the outer edge of the detection area. The derived reference signal is set by a predetermined relationship to a value above the reference signal. If a reflected signal stronger than the derived reference signal is detected by infrared detection device 18, a water flow source control signal is output through timing mechanism 20 to relay 24 to open water solenoid valve 6. Therefore, depending upon the relationship between the reference and derived reference signals, an object must be somewhat closer to infrared receiver 10 than the detection area outer edge in order to activate water solenoid valve 6.

Timing mechanism 20 is operatively disposed between infrared detection device 18 and relay 24 to discontinue water flow source control signals after a predetermined activation period. Timing mechanism 20 thus prevents an object left inadvertently, or through vandalism, within the detection area from causing continuous water flow. The activation period may be set to any optimal time period, for example 30 seconds in a preferred embodiment. It is understood, however, that longer periods may be required, for example in hospital surgical areas where the average hand washing time is relatively long.

Timing mechanism 20, furthermore, prevents water flow until the object is removed from the detection area for a predetermined period, approximately one to two seconds in this embodiment. Therefore, if a towel is placed over the edge of the sink so as to activate the water faucet, timing mechanism 20 deactivates water flow after approximately 30 seconds, and prevents subsequent water flow until the towel is removed or, as described below, the detection area is redefined so as to exclude the towel.

The detection area is redefined by infrared source drive 22. Infrared source drive 22 receives the amplified electrical signals from infrared sensor signal conditioner 16 as described above and compares these signals to predetermined criteria comprising signals from threshold level generator 14 corresponding to the expected intensity of signals reflected from the outer boundary of the detection area, subsequently adjusting the intensity of infrared signals emitted from infrared signal source 12 so that subsequent amplified electrical signals will more closely approximate the reference signal.

For example, upon installation the infrared signals emitted from infrared signal source 12 may be relatively weak. Consequently, the amplified electrical signals corresponding to the reflections therefrom may be below the reference signal. Responsive to this condition, infrared source drive 22 increases the intensity of infrared signals emitted from infrared signal source 12 until the amplified electrical signals approximate the reference signal. At this point, a steady state detection area is defined. Because, in this steady state, the infrared signals are probably reflected from the sink edge, the outer boundary of the newly-defined detection area approximately corresponds to this sink edge opposite to the faucet.

As discussed above, infrared detection device 18 will not output water flow source control signals capable of activating water solenoid valve 6 until detecting amplified electrical signals greater than the above-described derived reference signal. Because the derived reference signal is greater than the reference signal corresponding to the outer boundary of the steady state detection area, the signal received from the steady state boundary will not cause water solenoid valve 6 to be activated. An object interposed, however, between infrared signal source 12 and the outer boundary of the steady state detection area will reflect signals of greater intensity than the outer boundary. If the amplified electrical signals corresponding thereto exceed the above-described derived reference signal at infrared detection device 18, water solenoid valve 6 will be activated.

Thus, the relationship between the reference signal at infrared source drive 22 and the derived reference signal at infrared detection device 18 determines the position within the detection area at which an interposed object will activate water solenoid valve 6. Specifically, the distance of an interposed object in the detection area from infrared signal source 12 required to activate water solenoid valve 6 decreases as the difference between the two reference signals increases. That is, the higher the derived reference signal is set with respect to the reference signal, the higher the amplified electrical signals must be to activate water solenoid valve 6 and, consequently, the closer the interposed object must be to infrared signal source 12.

The amplified electrical signals that cause water solenoid valve 6 to be activated are also received, however, by infrared source drive 22. As discussed above, these amplified electrical signals exceeding the derived reference signal will also exceed the reference signal. Responsively, infrared source drive 22 decreases the intensity of infrared signals emitted from infrared signal source 12, causing subsequent amplified electrical signals to more closely approximate the reference signal. When, as discussed above, the amplified electrical signals approximately equal the reference signal, a new steady state detection area is defined having an outer boundary corresponding to the interposed object. Because the amplified electrical signals are now also below the derived reference signal, water solenoid valve 6 will not be activated unless a second object is interposed within the newly defined detection area.

As discussed above, the calibrating mechanism adjusts the intensity of infrared signals to approximate the predetermined reference signal. It will be understood by those of ordinary skill in the art, however, that, regarding another preferred embodiment, calibrating mechanism 22 may alternatively control the output of threshold level generator 14 so that the reference signal approximates the intensity of reflected infrared signals. By retaining the relationship between the reference and derived reference signals as discussed above, the self-calibrating water flow control apparatus operates equivalently to the preferred embodiment described above. That is, rather than adjusting infrared signal intensity to approximate the reference signal, it is understood to be within the scope of the invention to adjust the reference signal to approximate the infrared signal intensity.

From the above discussion, therefore, it will be seen that both timing mechanism 20 and infrared source drive 22 operate to stop water flow following the activation of water solenoid valve 6, the former by deactivating water solenoid valve 6 after a predetermined time and the latter by redefining the detection area so as to exclude the interposed object therefrom. Preferably, however, infrared source drive 22 alters the intensity of infrared signals emitted from infrared signal source 12 at a predetermined rate such that timing mechanism 20 deactivates water solenoid valve 6 before the detection area is redefined. Thus, if an object is left within the detection area beyond the predetermined activation period, timing mechanism 20 deactivates the water flow and does not permit water flow thereafter until there is no longer an object therein. If the object is not subsequently removed, however, infrared source drive 22 redefines the detection area so as to exclude the object and permit subsequent faucet use. By this configuration, therefore, an object indefinitely interposed within the initial detection area causes neither the continuous activation of water solenoid device 6 nor the indefinite deactivation of water solenoid valve 6 following the expiration of the activation period of timing mechanism 20.

For example, a towel placed over the edge of a sink may cause water solenoid valve 6 to be activated. As described above, there is a predefined relationship between the reference signal output from threshold level generator 14 and the reference signal derived therefrom by infrared detection device 18. The relationship may be such that the derived signal is some percentage higher than the reference signal, in this embodiment 105 percent. This relationship is independent of the size of the detection area and will be maintained as new detection areas are defined as described above. The relationship is typically set so that a pair of hands placed within a sink will not activate water solenoid valve 6 until they are relatively close to the faucet.

The intensity of reflected infrared signals, however, is determined not only by position from the infrared signal source 12, but also by ambient temperature and the color of the interposed object. Thus, for example, a dark sink edge requires a relatively higher intensity infrared beam upon initial calibration than does a lighter colored sink. Also, because the relationship between the reference signals is set to accommodate human hands, bright objects reflecting stronger infrared signals may activate water solenoid valve 6 from a distance farther from infrared signal source 12 than would the pair of human hands. Thus, it is a not uncommon problem that a white towel placed over a sink edge could activate water solenoid valve 6.

In such a situation, referring again to FIG. 1, timing mechanism 20 deactivates water solenoid valve 6, and thereby ceasing water flow, at the expiration of the activation period from the time the towel is placed over the sink's edge. Absent the operation of infrared source drive 22, timing mechanism 20 would not allow reactivation of water solenoid valve 6 until the towel was removed. Thus, someone placing his hands within the sink would find that the faucet would not work and might not realize that the towel must first be removed. Infrared source drive 22, however, recalibrates the continuously self-calibrating water flow control apparatus so as to redefine the detection area to exclude the towel. Because, as described above, infrared detection device 18 will not activate water solenoid valve 6 once a steady state (having no interposed objects) detection area has been redefined, timing mechanism 24 no longer detects an interposed object within the detection area. That is, from the perspective of timing mechanism 20, the interposed object has been removed, and water solenoid valve 6 will activate only upon the interposition of a second object within the newly defined detection area.

Infrared source drive 22 continuously recalibrates the infrared signal intensity from infrared signal source 12. Thus, if an object placed in a sink generates a new detection area and is then removed, infrared source drive 22 will again redefine the detection area. If there are no other objects within the sink, the detection area will again extend to the sink edge. Furthermore, the continuous self-calibration allows automatic calibration upon installation with such assemblies of various sizes and colors, thereby avoiding time-consuming and inaccurate manual calibration.

Preferably, only infrared signal intensities incapable of causing human eye damage are used. That is, there is an upper limit to which infrared source drive 22 will adjust the intensity of infrared signals emitted from infrared signal source 12. Therefore, the "hunt" for an outer edge to the detection area is limited to a preset maximum infrared source level. Once this level is obtained, a stable operating point results. The resulting detection area will be unusually large but will operate as described above, except that the outer boundary of the detection area is no longer a physical structure. The reference level and derived reference level remain fixed. Thus, at this maximum infrared signal source intensity, there is a finite distance from infrared signal source 12 at which water solenoid valve 6 will be activated. The intangible detection area outer boundary, then, is defined by the preset relation between the reference level and the derived reference level as described above. Therefore, the apparatus according to this presently preferred embodiment may be utilized in conventional stand-up urinals, which would not have basin edges opposite from infrared signal source 12, as well as conventional sink assemblies.

As described above, infrared signal source 12 continuously emits infrared signals into the detection area. Although the choice of the emission rate is not inherently critical, it is preferable that the duty cycle (ratio of beam on-time to off-time) be extremely low. First, a low duty cycle reduces the possibility of harm caused by the infrared signal source. Second, such a duty cycle reduces energy consumption, as would be important in the preferred embodiment comprising a microprocessor and battery power source described above. Third, a rapidly changing pulse signal is more easily detected, even at extremely low power levels.

Figure 2A:
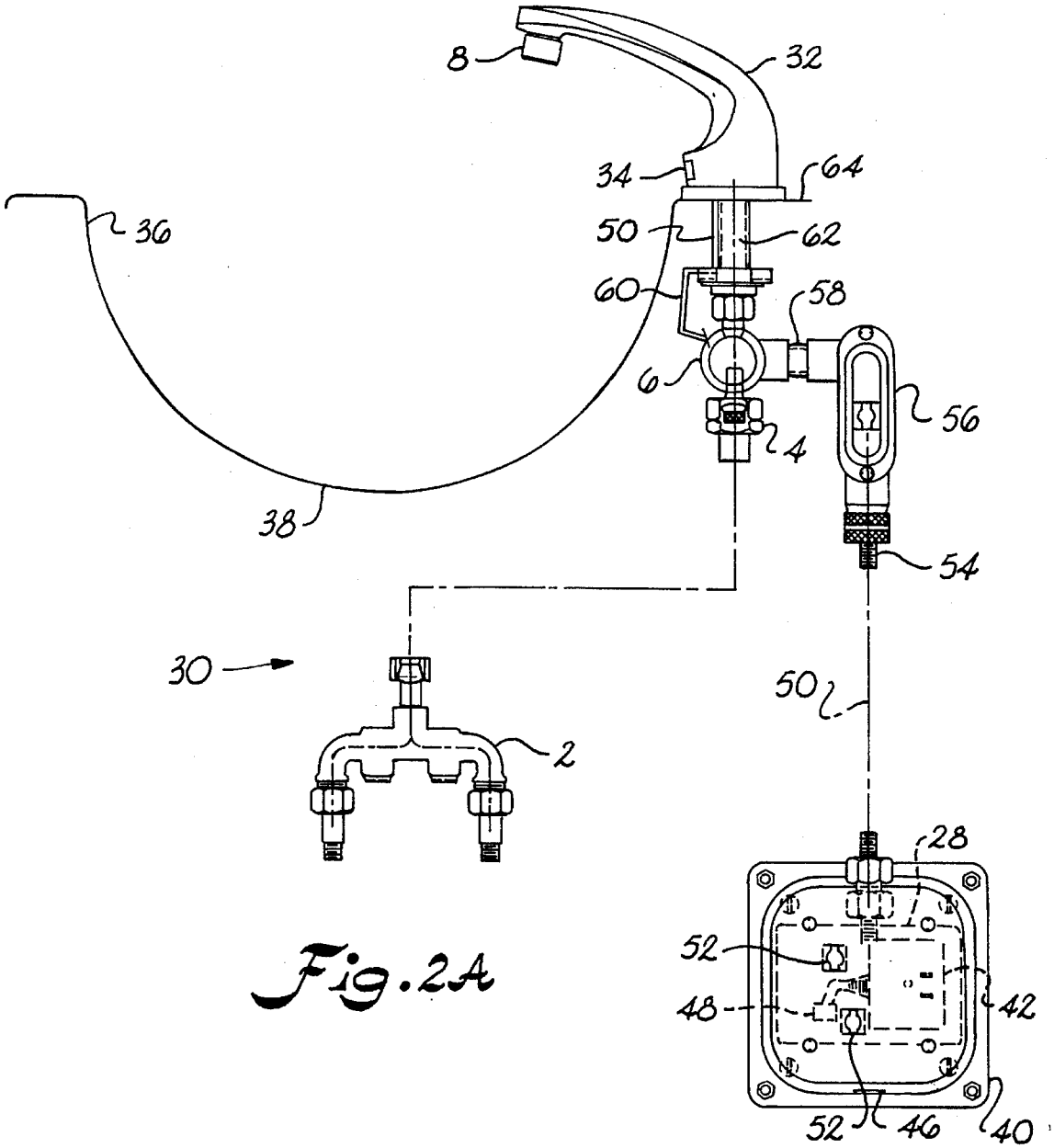
FIG. 2A is an elevational view of a realization of the embodiment of the invention as in FIG. 1.
Figure 2B:
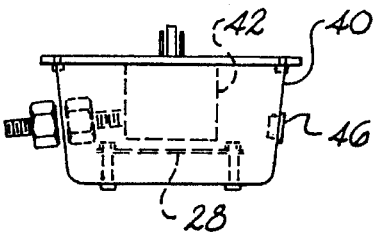
FIG. 2B is a side elevational view of the electrical control box as in FIG. 2A.

Referring now to FIGS. 2A and 2B, another presently preferred embodiment of the present invention is depicted, encompassing a water faucet and sink assembly indicated generally at 30 and including the continuously self-calibrating water flow control apparatus as described above. Specifically, infrared signal source 12 and infrared receiver 10 (FIG. 1) are housed within the base of faucet 32. Infrared signal source 12 is isolated from infrared receiver 10 by an opaque mounting and aiming block (not shown). Both are housed behind an infrared filtering and protection lens 34.

As described above, upon installation infrared source drive 22 calibrates the infrared signals emitted by infrared signal source 12 (FIG. 1) to define a detection area. In the embodiment depicted in FIG. 2, the detection area's initial steady state outer boundary will be the far edge 36 of water basin 38. Infrared signal source 12 does not, however, direct a fine beam at far edge 36. Rather, the infrared signals spread out, in this embodiment over a nominal +/−22° angle. Thus, an interposed object need not strictly intervene between infrared signal source 12 and far side 36 of water basin 38 to activate water solenoid valve 6, but rather need merely reflect any part of the diffuse beam back to infrared receiver 10 at a sufficient strength. Additionally, because of the beam spread, the infrared signals are directed at a somewhat downward angle from infrared signal source 12, thereby creating a detection area that extends down into the space defined by water basin 38 and slightly above the edge thereof.

The continuously self-calibrating water flow control apparatus as described above may be configured to be retrofitted into a conventional water faucet and sink assembly. A self-calibrating water flow control apparatus designed within a water faucet and sink assembly is shown in FIG. 2A. FIG. 3A depicts such a design within a water faucet assembly shown in cross section. Referring to FIGS. 2A, 2B, 3A and 3B, water source 2 supplies water through water filter 4 to water solenoid valve 6, which controls water flow to faucet 32. Water solenoid valve 6, in turn, is controlled by the continuously self-calibrating water flow control apparatus as described above. Furthermore, as described above, infrared signal source 12 and infrared receiver 10 are housed at the base of faucet 32. Electronic control board 28, in this embodiment is housed in electrical control box 40.

Electrical control box 40 houses both electronic control board 28 and transformer 42. Electrical safety around water pipes (grounded fixtures) dictates the use of a low voltage power supply. The common 24 VAC transformer 42 is used to convert building power to 24 VAC for distribution to one or more electronic control boards 28. The 24 VAC rating is chosen because of safety ratings, availability, size, and cost. Linear transformers lose some power in the voltage step-down; however, the numerous input voltage ratings, suppliers, and its compact size overcome this shortcoming. The UL, CSA, and VDE approved line-isolation transformer protects the user from electrical shock. Additionally, all components of this presently preferred embodiment are housed in conductive metal enclosures, all of which are grounded via an electrical system safety ground (not shown), thus preventing any short circuits from energized user contacted parts, even if the plumbing installation contains some plastic components.

Although the configuration as in FIGS. 2A and 3A depicts a single power source for a single electronic control board 28, electrical control box 40 may be configured for a dual power supply option as shown in FIG. 3B. That is, one power supply may serve a number of electronic control boards 28. To that end, power line 44 passes through opening 46 in electrical control box 40. Furthermore, if the components disposed on electronic control board 28 comprise digital circuitry, for example comprising a microprocessor 23 as in FIG. 5, a lesser power source would be required as is understood in the art. Thus, transformer 42 could be replaced, for example, by a battery 25. As will also be understood in the art, such a power supply choice may require variations of the configuration of, or power supplied to, water solenoid valve 6 from that described below.

In selecting transformer 42, the power rating must allow transformer 42 to continuously supply the one or more connected faucet systems, including water solenoid valves 6. The electronic control board 28 is allowed one watt in power calculations. A small 20 watt transformer plugging directly into a 115 volt outlet may supply one or two systems utilizing an 8 watt 24 VAC solenoid. If, instead, a 4 watt 24 VAC solenoid is employed, one small 20 watt transformer may supply 4 faucet systems in operation at the same time. In this embodiment, power is supplied from transformer 42 to electronic control board 28 at power jack 48.

Signals are communicated between electronic control board 28 and the infrared components housed in faucet 32 via signal line 50. In this embodiment, signal line 50 is comprised of 6—6 connector wire in communication with electronic control board 28 at jack 52. Additionally, water flow source control signals are communicated from electronic control board 28 to water solenoid valve 6 over signal line 50 through conduit 54 to conduit box 56 and through close nipple 58. Signals to and from infrared signal source 12 and infrared receiver 10 pass, via signal line 50, around water solenoid valve 6 through pigtail 60 and a hole through sink top 64.

Figure 4:
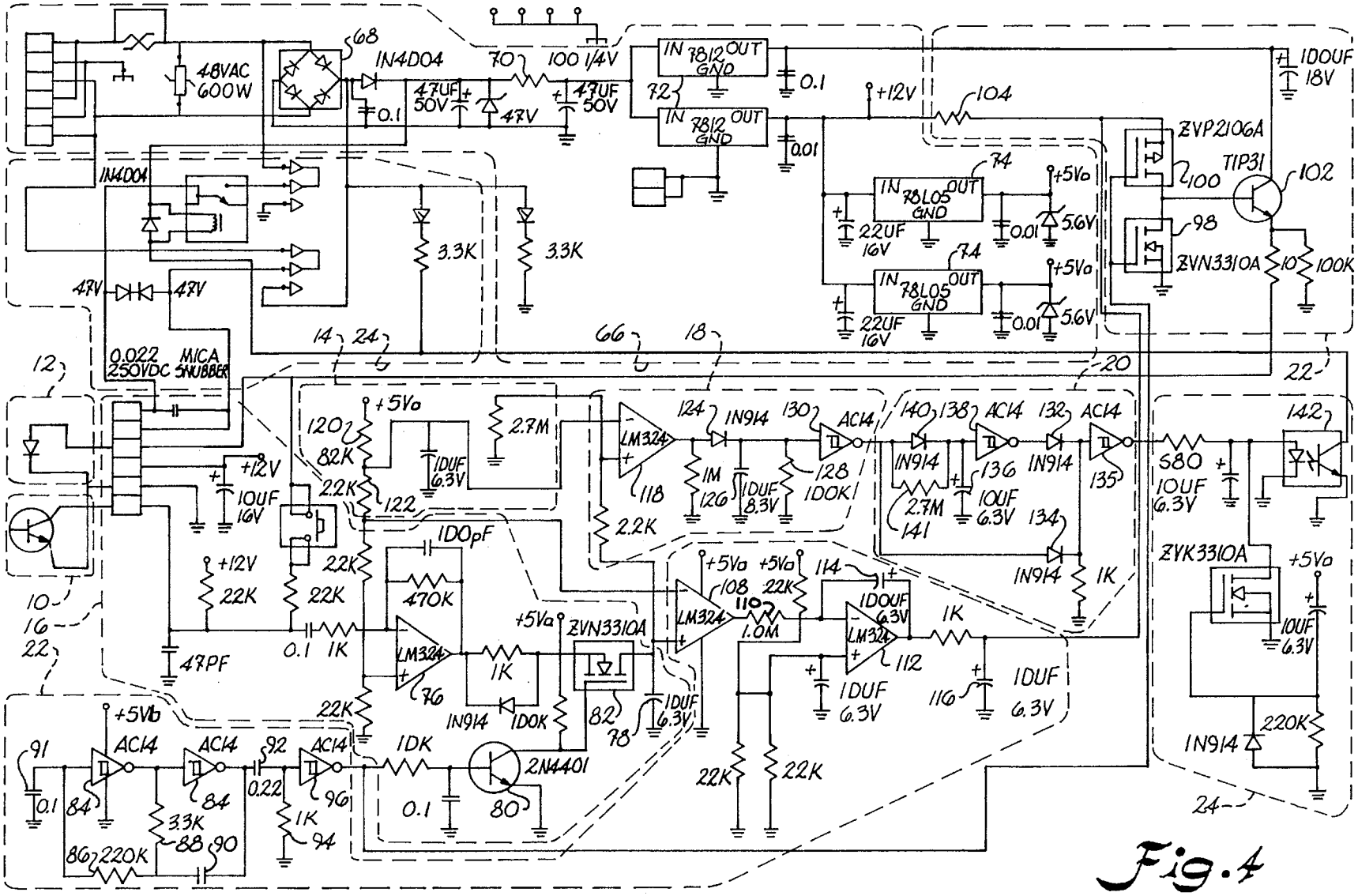
FIG. 4 is a schematic illustration of the control and calibrating devices of the embodiment of the invention as in FIG. 1.

Referring now to FIG. 4, one preferred realization of the self-calibrating fluid flow control apparatus is depicted. The circuitry therein described is presented, however, as a means of explanation and example only, not as a means of limitation. For example, any equivalent analog or digital circuitry are understood to be within the scope of the present invention.

The power supply section 66 of electronic control board 28 develops the necessary voltages for board functions and protects against input power excursions. Most of the circuitry upon electronic control board 28 requires five volts; however, a 12 volt drive for infrared signal source 12 and a 24 volt DC solenoid option are also provided. More specifically, the electronic control board 28 rectifies the 24 VAC signal through a one-amp diode bridge 68 to yield a 32 VDC pulsating signal. This signal is presented as an option for utilizing DC water control solenoids if necessary. The 32 VDC signal is dropped to positive 20 volts across 100 ohm ¼ watt resistor 70 and is then applied to the input of 12 volt linear regulators 72. Although sufficient space is otherwise provided, resistor 70 dissipates enough energy so that regulators 72 do not require heat sinks. The output of regulators 72 is used to drive the inputs of the five volt regulators 74 and to power the drive circuits for the infrared signal source 12 in faucet 32. The two five volt regulators 74 are used to separate the power to the analog op-amps from the power to the digital inverters discussed below, thereby preventing many electrical noise problems. The inverters utilized in infrared detection circuit 18 and timing mechanism 20 are relatively immune to parasitic noise from the drive pulse generation.

Threshold generator 14 establishes a small but very constant voltage difference between the reference signal and the derived reference signal discussed above. The reference signal is used by infrared source drive circuit 22 as a reference to define the steady state outer boundary of the detection area. The higher derived reference signal is used by infrared detection circuit 18 as a reference to "detect" an object interposed within the detection area causing an infrared reflection higher than that from the detection area's outer boundary. The derived reference signal is also used to establish a DC operating point for signals fed to the infrared source drive circuit 22 and infrared detection circuit 18. The values of the reference and derived reference signals may vary, but the difference between them affects faucet performance as is discussed above, and in more detail below.

The infrared receiver 10 comprises a phototransistor located in faucet 32 with a viewing axis parallel to the infrared signal source 12. The infrared receiver converts reflected infrared energy into an electrical signal. Due to the very high impedances involved, the infrared photo-transistor has its own biasing network (not shown) located near the photo-transistor inside the base of faucet 32. The electronic control board 28 supplies the infrared photo-transistor with positive five volts, ground, and signal connections. An infrared optical filter (not shown) aids in removing ambient light biasing effects on the photo-transistor operating point and in obscuring the photo-transistor window from vandals.

The infrared sensor signal conditioner 16 amplifies and detects the very weak signals picked up by infrared receiver 12. The input signal from the photo-transistor is passed to op-amp 76. Op-amp 76 is a negative amplifier with a ×470 gain. The amplified positive pulses are accumulated on capacitor 78. Pulses are permitted by transistors 80 and 82 to charge capacitor 78 only in conjunction with the generation of signals by infrared source drive 22 driving infrared signal source 12.

Because capacitor 78 is configured to slowly discharge, its voltage corresponds to the intensity of incoming reflected infrared signals. That is, a single pulse produces a voltage across capacitor 78, which then discharges. Successive pulses of equal intensity are required to charge capacitor 78 to an approximately stable voltage level. Thus, the voltage across capacitor 78 rises and falls according to the rise and fall of the received infrared signals.

Infrared source drive circuit 22 generates narrow variable height pulses of sufficient power to vary the infrared light output of infrared signal source 12 in faucet 32. These pulses are at a constant frequency and pulse width (duty cycle) but vary in voltage height. The pulses originate as square waves generated by the pair of schmitt trigger inverters 84. The frequency of the square wave, determined by resistors 86 and 88 and capacitors 90 and 91, is approximately 30 Hz. The square wave rising edges are converted to pulses by capacitive coupling through capacitor 92 and biasing by resistor 94 to produce positive going spikes at the input of schmitt trigger inverter 96, which re-squares the positive spikes into positive pulses with a 200 microsecond duration, giving a 0.6 percent duty cycle. The resultant pulses are fed to the bases of field effect transistor (FET) pair 98 and 100, which form a level shifted drive for power transistor 102, which, in turn, directly drives infrared signal source 12. The level shifting occurs because the source of FET 98 is attached to ground. A high on the FET 98 gate drags the FET 98 drain and power transistor 102 base low. At the same time, the high on the gate of FET 100 turns FET 100 off, allowing its drain to be taken low by FET 98. During the gate-low time, FET 98 turns off and FET 100 turns on, driving the FET 100 drain and power transistor 102 base to the voltage level at the source of FET 100.

The voltage level at the source of FET 100 is determined by the summing of two voltages on capacitor 116. First, power supply 66 provides a pull-up voltage through resistor 104. A second voltage source is derived from the incoming reflected infrared signal presented to comparator 108 by capacitor 78.

Comparator 108 compares the incoming reflected signal voltage across capacitor 78 to the reference voltage provided by threshold level generator 14 corresponding to the expected intensity of infrared signals reflected from the detection area's outer boundary. If the incoming signals are weaker than the reference signal, indicating a need to expand the detection area, comparator 108 outputs a high. Such high signal causes the extremely slow integrator comprised of resistor 110, op-amp 112, and capacitor 114 to raise the voltage level output by op-amp 112, thereby proportionally raising the voltage sum on capacitor 116. The increased voltage across capacitor 116 raises the voltage level provided by FET 100 to the base of transistor 102, thereby increasing the intensity of the infrared signals emitted from infrared signal source 12. Consequently, the voltage across capacitor 78 increases and approaches the reference signal provided by threshold generator 14.

When the incoming signals are stronger than the reference signal, indicating a need to reduce the detection area, comparator 108 outputs a low. This low signal causes the above-described extremely slow integrator to lower the voltage level output by op-amp 112, thereby proportionally lowering the voltage sum on capacitor 116. The decreased voltage across capacitor 116 lowers the voltage level provided by FET 100 to the base of transistor 102, thereby decreasing the intensity of the emitted infrared signals from the infrared signal source 12. Consequently, the voltage across capacitor 78 decreases and approaches the reference signal provided by threshold generator 14.

Eventually the incoming signals approximate the reference signal, indicating a steady state detection area boundary has been achieved. Comparator 108 continues, however, to output an oscillating signal caused by random signal noise typical of electronic circuits. As long as such oscillation averages evenly between high and low, the extremely slow integrator maintains a steady voltage on capacitor 116. This steady voltage across capacitor 116 steadies the level provided by FET 100 to the base of transistor 102, thereby maintaining the intensity of the emitted infrared signals from the infrared signal source 12. Consequently, the voltage across capacitor 78 reaches a steady state value very close to the level of the reference signal provided by threshold generator 14. This feedback mechanism removes, for example, operational variations due to circuit component value fluctuations caused by manufacturing tolerances, local temperature, circuit component aging, component inefficiencies during infrared signal generation and reception, and effects due to outer boundary color and distance. In a steady state environment, therefore, this cycle would continually redefine the detection area outer boundary, thereby permitting, for example, the installation of a larger sized or darker colored sink without requiring manual calibration.

As discussed above, the reference signal is set at a predetermined relationship below the derived reference signal. Comparator 118 of infrared detection circuit 18 compares the incoming reflected infrared signal voltage from capacitor 78 to the reference signal derived from threshold level generator 14 between resistors 120 and 122. Also, as discussed above, and as can be seen by the configuration of threshold level generator 14, when the reflected infrared signal voltage across capacitor 78 approximates the reference voltage at comparator 108, such voltage will necessarily be below the derived reference voltage at comparator 118, driving the output of comparator 118 low. The output of schmitt trigger inverter 130, therefore, will be high, causing, as is discussed in more detail below, the deactivation of water solenoid valve 6.

When, however, an object is interposed within the detection area so as to increase the voltage across capacitor 78 such that it exceeds the derived reference voltage, comparator 118 outputs a high signal through diode 124 to capacitor 126 and resistor 128, causing a voltage to be collected across capacitor 126. This, in turn, causes the output of schmitt trigger inverter 130 to go low, causing the activation of water solenoid valve 6 as discussed below. When the object has been removed from the detection area, or when the detection area has been redefined to exclude the object, the output of comparator 118 will again go low, causing capacitor 126 to discharge slowly through resistor 128. Effectively, a positive signal from comparator 118 charges capacitor 126 quickly through diode 124, but the lack of such a signal causes capacitor 126 to discharge slowly, creating a minimum on-time and a short delay in the transition from "on" to "off." This on to off delay permits hands to momentarily leave the detection area and re-enter without causing the water to quickly sputter off and on. Additionally, schmitt trigger inverter 130 reshapes the analog charge/discharge signal into the water demand on/off signal.

The water flow source control signals from schmitt trigger inverter 130 must pass through timing mechanism 20. Timing mechanism 20 prevents an object left indefinitely in the detection area from causing water to flow continuously. In this embodiment, timing mechanism 20 permits water flow for about 30 seconds, then discontinues water flow until the object is removed from the detection area for approximately one to two seconds (the discharge time of capacitor 126 and resistor 128). Thus, timing mechanism 20 selectively permits water flow depending upon the interposition of objects within the detection area, the time the objects remain therein, and the detection area's recalibration.

Operatively, if a low signal is presented to relay 24 by a high on diodes 132 and 134 inverted by inverter 135, water solenoid valve 6 will not be activated. Thus, as described above regarding the steady state detection area condition, the output of the schmitt trigger inverter 130 is high, driving the output of diode 134 high and thereby deactivating water solenoid valve 6. In this steady state condition, the high output of schmitt trigger inverter 130 drives a voltage across capacitor 136 through diode 140, causing the output of schmitt trigger inverter 138 and, consequently, diode 132 to go low. If an object is interposed within the detection area, causing the output of schmitt trigger inverter 130 and diode 134 to go low, the output of diode 132 initially remains low because of the relatively slow discharge rate of capacitor 136 through resistor 141, activating water solenoid valve 6. Timing mechanism 20 is configured such that the charge on capacitor 136 takes approximately 30 seconds to decay below the point where schmitt trigger inverter 138 drives diode 132 high and inverter 135 low, forcing water solenoid valve 6 to deactivate. That is, water will flow only while both diodes 132 and 134 are low.

As long as the object remains interposed within the detection area, the output of schmitt trigger 130 will remain low and the output of diode 132 will remain high, preventing reactivation of water solenoid valve 6. Only when the object is removed or the detection area is redefined so as to remove the object will the output of schmitt trigger inverter 130 return high. Only then will capacitor 136 recharge, thereby permitting the reactivation of water solenoid valve 6.

As indicated above, the choice of resistors 120 and 122 determines the difference between the reference and the derived reference signals and, consequently, the difference between the outer boundary of the detection area and the point at which water solenoid valve 6 will be activated due to a given object interposed therein. Thus, the point at which water solenoid valve 6 will be activated for a given object within the detection area, as a function of the relation between the outer boundary and the size of the detection area, will remain the same regardless of the detection area's size. It is understood, furthermore, that the reference and derived reference signals may be set by digital circuitry or by adjustable resistors. The latter configuration permits an operator to adjust the point within the detection area at which an interposed object activates the faucet without replacing any circuit elements.

Relay 24, and specifically photo-isolator 142, converts the five volt logic signal from timing mechanism 20 into a 24 VDC signal necessary to pull in the relay. When driven by the logic, the phototransistor conducts and "grounds" one side of the relay coil. With the other side of the relay coil attached to 24 VDC, relay 24 is energized, and its contacts apply 24 VAC across the solenoid coil of water solenoid valve 6 (or, optionally, a 24 VDC signal across the solenoid coil).

Whether a 24 VAC or 24 VDC solenoid is employed, the solenoid is a normally closed type, so that during a power loss, the default state is "off." An energized solenoid permits water to flow. To reduce the power requirements for action against water pressure (up to 150 psi) and yet allow a sufficiently high flow rate when the valve is open (3 gallons per minute at 60 psi), a "pilot" valve (not shown) is required. Pilot valves have very small orifices to direct water pressure to aid in opening and closing the large main valve. These small orifices require a contaminant filter 4 to remove debris such as sand from the water stream. Preferably, filter 4 is easily removed, cleaned and reinstalled.

The method according to the present invention for controlling fluid flow from a fluid flow assembly may be practiced, for example, using the components described above. The method includes the step of selectively permitting, upon the interposition of an object within a defined detection area, fluid flow from a fluid source to the fluid flow assembly. As described above, the fluid flow activation is selective, dependent upon, for example, the color and temperature of the object interposed within the detection area, the configuration of timing mechanism 20 (FIG. 4), and the relationship between the reference signal and the derived signal as described above. The method further includes continuously defining, at a predetermined rate, a steady state boundary of the detection area, whereby the steady state boundary is conformed to objects interposed within the detection area so that a new detection area is defined which is free of interposed objects capable of activating the fluid flow assembly, for example a water faucet as in FIG. 2. Preferably, the relationship between the reference signal and the derived reference signal as described above is set so that an object interposed within the detection area activates water solenoid valve 6 (FIG. 2) at a desired distance from faucet 32.

The permitting step is further comprised of the steps of emitting, at a predetermined rate, an infrared signal into the detection area, receiving reflections thereof from objects interposed within the detection area and generating electrical signals corresponding thereto, outputting, for example, water flow source control signals to, for example, the water flow source such that when the electrical signals approximate the reference signal, the water flow source is not activated, and presenting the water flow control signals to water solenoid valve 6 (FIG. 2) via relay 24 (FIG. 4) in a form actable upon by water solenoid valve 6.

The defining step further preferably comprises the steps of comparing the received reflected infrared signals to a predetermined reference signal and adjusting, responsive to the comparison, the intensity of the infrared signal subsequently emitted so that subsequent electrical signals corresponding to reflections therefrom approach the predetermined reference signal.

Additional embodiments of the method of the method according to the present invention have already been discussed above with regard to the discussion of the apparatus according to the present invention and need not be repeated.

While particular embodiments of the invention have been described and shown, it will be understood by those of ordinary skill in this art that the present invention is not limited thereto since many modifications can be made. Therefore, it is contemplated by the present application to cover any and all such embodiments that may fall within the scope of the invention in the appended claims.

What is claimed is:

1. A continuously self-calibrating fluid flow control apparatus for utilization with a fluid flow source, comprising:

an infrared signal source configured to repeatedly emit, at a predetermined rate, an infrared signal into a defined detection area;

an infrared receiver configured to receive reflections of said infrared signals from objects within said detection area and generate electrical signals corresponding to said reflections;

a calibrating mechanism in communication with said infrared receiver and said infrared signal source and configured to compare said received infrared signal to at least one predetermined reference signal and adjust, responsive to said comparison, the intensity of infrared signals subsequently emitted by said infrared signal source so that the subsequent electrical signals corresponding to reflections therefrom approach said at least one predetermined reference signal; and a control mechanism in communication with said infrared receiver and configured to output, responsive to said electrical signals, fluid flow source control signals to the fluid flow source, wherein said control mechanism is further configured so that when said electrical signals approximate said at least one reference signal, the fluid flow source is not activated.

2. The continuously self-calibrating fluid flow control apparatus as in claim 1, further comprising an interface device operatively disposed between said control mechanism and the fluid flow source and configured to present said fluid flow source control signals to the fluid flow source in a form actable upon by the fluid flow source.

3. The continuously self-calibrating fluid flow control apparatus as in claim 1, wherein said control mechanism further comprises a timing mechanism in communication with said control mechanism and configured to deactivate the fluid flow source after a predetermined activation period and to prevent the subsequent activation of the fluid flow source until at least one of the removal of said objects from said detection area and the approximation of said electrical signals to said at least one predetermined reference signal.

4. A water faucet assembly, comprising:

a faucet operatively connected to a water source;

a valve configured to selectively permit water flow from said water source to said faucet; and a continuously self-calibrating water flow control apparatus operatively connected to said valve; comprising:

a control device configured to open said valve, thereby activating said faucet, upon the interposition of an object within a defined detection area relative to said faucet; and a calibrating device in communication with said control device and configured to continuously define, at a predetermined rate, a steady state boundary of said detection area conforming to objects interposed within said detection area such that said conforming steady state boundary excludes objects capable of activating the faucet.

5. The water faucet assembly as in claim 4, wherein said control device further comprises a timing mechanism configured to deactivate the water flow source after a predetermined activation period.

6. The water faucet assembly as in claim 5, further comprising a power source operatively connected to said continuously self-calibrating water flow control apparatus.

7. The water faucet assembly as in claim 5, wherein said control device comprises:

an infrared signal source configured to emit an infrared signal into said detection area;

an infrared receiver configured to receive reflections of said infrared signals from objects within said detection area and generate electrical signals corresponding to said reflections; and a control mechanism configured to output, responsive to said electrical signals corresponding to said reflections of said infrared signals, water flow control signals to said valve capable of controlling the operation of said valve, and wherein said calibrating device comprises a calibrating mechanism configured to compare said electrical signals to at least one predetermined reference signal and adjust, responsive to said comparison, the intensity of infrared signals subsequently emitted by said infrared signal source so that the subsequent electrical signals corresponding to reflections therefrom approach said at least one predetermined reference signal.

8. A continuously self-calibrating fluid flow control apparatus for utilization with a fluid flow system, comprising:

a control device mateable with said fluid flow system and configured to activate a water flow source of the fluid flow system upon the interposition of an object within a defined detection area; and a calibrating device in communication with said control device and configured to continuously redefine, at a predetermined rate, a steady state boundary of said detection area, wherein said steady state boundary conforms to objects interposed within said detection area so that a new detection area is defined which is free of interposed objects capable of activating the fluid flow system.

9. The continuously self-calibrating fluid flow control apparatus as in claim 8, wherein said control device is configured to activate said fluid flow source when said object is interposed at a predetermined position within said detection area and wherein the relationship between said predetermined position and the position of said boundary is preserved by said calibrating device.

10. The continuously self-calibrating fluid flow control apparatus as in claim 8, wherein said control device comprises:

an infrared signal source configured to emit an infrared signal into said detection area;

an infrared receiver configured to receive reflections of said infrared signals from objects within said detection area and to generate electrical signals corresponding to said reflections; and a control mechanism in communication with said infrared receiver and configured to output, responsive to said electrical signals corresponding to said reflections of said infrared signals, fluid flow source control signals to the fluid flow source.

11. The continuously self-calibrating fluid flow control apparatus as in claim 10, wherein said control device further comprises a timing mechanism in communication with said control mechanism and configured to deactivate the fluid flow source after a predetermined activation period.

12. The continuously self-calibrating fluid flow control apparatus as in claim 10, further comprising an interface device operatively disposed between said control mechanism and the fluid flow source and configured to present said fluid flow source control signals to the fluid flow source in a form actable upon by the fluid flow source.

13. The continuously self-calibrating fluid flow control apparatus as in claim 10, wherein said control mechanism is comprised of a microprocessor.

14. The continuously self-calibrating fluid flow control apparatus as in claim 10, wherein said calibrating device is configured to repeatedly compare said electrical signals to predetermined criteria and calibrate, responsive to said comparison, the infrared signals subsequently emitted by said infrared signal source so that the subsequent electrical signals corresponding to reflections therefrom approach said predetermined criteria.

15. The continuously self-calibrating fluid flow control apparatus as in claim 14, wherein said control mechanism is configured such that when said electrical signals approximately satisfy said predetermined criteria, the fluid flow source is not activated.

16. The continuously self-calibrating fluid flow control apparatus as in claim 14, wherein said predetermined criteria comprise at least one reference signal corresponding to a desired intensity of said reflected signals.

17. The continuously self-calibrating fluid flow control apparatus as in claim 10, wherein said calibrating device is comprised of electrical circuitry configured to repeatedly compare said electrical signals to at least one predetermined reference signal and adjust, responsive to said comparison, the intensity of infrared signals subsequently emitted by said infrared signal source so that the subsequent electrical signals corresponding to reflections therefrom approach said at least one predetermined reference signal and wherein said control mechanism is configured such that when said electrical signals approximate said at least one reference signal, the fluid flow source is not activated.

18. The continuously self-calibrating fluid flow control apparatus as in claim 14, wherein said calibrating device is configured to adjust the intensity of said infrared signals at a predetermined rate, wherein said predetermined rate is set to permit the activation of the fluid flow source during a desired use.

19. The continuously self-calibrating fluid flow control apparatus as in claim 10, wherein said calibrating device comprises a microprocessor.

20. The continuously self-calibrating fluid flow control apparatus as in claim 8, wherein said continuously self-calibrating fluid flow control apparatus is configured to be retrofitted into a fluid flow assembly.

21. The continuously self-calibrating fluid flow control apparatus as in claim 10, wherein said calibrating device is configured to repeatedly compare said electrical signals to predetermined criteria and adjust, responsive to said comparison, said predetermined criteria so that said adjusted criteria approach the electrical signals corresponding to reflections from subsequently emitted infrared signals.

22. The continuously self-calibrating fluid flow control apparatus as in claim 21, wherein said calibrating device is configured such that when said electrical signals approximately satisfy said predetermined criteria, the fluid flow source is not activated.

23. The continuously self-calibrating fluid flow control apparatus as in claim 8, further comprising a power source operatively connected to said control device and said calibrating device.

24. The water faucet assembly as in claim 23, wherein said power source comprises a battery.

25. A method of controlling fluid flow from a fluid flow assembly, comprising:

selectively permitting, upon the interposition of an object within a defined detection area, fluid flow from the fluid flow assembly; and continuously defining, at a predetermined rate, a steady state boundary of said detection area to conform to objects interposed within said detection area so that said conforming steady state boundary excludes objects capable of activating the fluid flow assembly.

26. The method as in claim 25, wherein the fluid flow assembly is activated when said object is interposed at a predetermined position within said detection area and wherein the relationship between said predetermined position and the position of said boundary is preserved during said defining step.

27. The method as in claim 25, wherein said permitting step further comprises the steps of:

emitting infrared signals into said detection area;

receiving reflections of said infrared signals from objects within said detection area and generating electrical signals corresponding to said reflections; and outputting, responsive to said electrical signals corresponding to said reflections of said infrared signals, fluid flow assembly control signals to the fluid flow assembly.

28. The method as in claim 27, wherein said defining step further comprises the steps of:

repeatedly comparing said electrical signals to predetermined criteria; and calibrating, responsive to said comparison, the infrared signals subsequently emitted during subsequent said emitting steps so that the subsequent electrical signals corresponding to reflections therefrom approach said predetermined criteria.

29. The method as in claim 28, wherein when said electrical signals approximate said predetermined criteria, the fluid flow assembly is not activated.

30. The method as in claim 28, wherein the intensity of said infrared signals is calibrated at a predetermined rate set to permit the activation of the fluid flow assembly during a desired use.

31. The method as in claim 25, wherein said permitting step is further comprised of the steps of:

emitting, at a predetermined rate, infrared signals into said detection area;

receiving reflections of said infrared signals from objects within said detection area and generating electrical signals corresponding to said reflections;

outputting, responsive to said electrical signals corresponding to said reflections of said infrared signals, fluid flow assembly control signals to the fluid flow assembly such that when said electrical signals approximate said at least one predetermined reference signal, the fluid flow assembly is not activated; and presenting said fluid flow assembly control signals to the fluid flow assembly in a form actable upon by the fluid flow assembly; and wherein said defining step further comprises the steps of comparing said received infrared signals to said at least one predetermined reference signal and adjusting, responsive to said comparison, the intensity of infrared signals subsequently emitted during subsequent said emitting steps so that the subsequent electrical signals corresponding to reflections therefrom approach said at least one predetermined reference signal.

32. The method of claim 31, wherein said permitting step further comprises the steps of:

deactivating the fluid flow assembly upon the expiration of a predetermined activation period; and preventing reactivation of the fluid flow assembly until at least one of the removal of said objects from said detection area and the approximation of said electrical signals to said at least one predetermined reference signal.

33. The method as in claim 27, wherein said defining step further comprises the steps of:

repeatedly comparing said electrical signals to predetermined criteria; and adjusting, responsive to said comparison, said predetermined criteria so that said adjusted criteria approach the electrical signals corresponding to reflections from subsequently emitted infrared signals.

34. The method as in claim 33, wherein when said electrical signals approximately satisfy said predetermined criteria, the fluid flow assembly is not activated.

35. The method as in claim 27, wherein said defining step further comprises the steps of:

repeatedly comparing said electrical signals to at least one predetermined reference signal; and adjusting, responsive to said comparison, said at least one predetermined reference signal so that said adjusted at least one reference signal approaches the subsequent electrical signals corresponding to reflections of said infrared signals, and wherein when said adjusted at least one reference signal approximates said electrical signals, the fluid flow assembly is not activated.

* * * * *